US008176999B2

(12) United States Patent
Stroud et al.

(10) Patent No.: US 8,176,999 B2
(45) Date of Patent: May 15, 2012

(54) STEERABLE DRILL BIT ARRANGEMENT

(75) Inventors: Daryl Richard Henry Stroud, Abbeymead (GB); Colin Walker, Conchez-de-Bearn (FR)

(73) Assignee: Smart Stabilizer Systems Limited, Tewkesbury (GB)

( * ) Notice: Subject to any disclaimer, the term of this patent is extended or adjusted under 35 U.S.C. 154(b) by 174 days.

(21) Appl. No.: 11/630,610

(22) PCT Filed: Jun. 22, 2005

(86) PCT No.: PCT/GB2005/002465

§ 371 (c)(1),
(2), (4) Date: Nov. 26, 2008

(87) PCT Pub. No.: WO2005/124090

PCT Pub. Date: Dec. 29, 2005

(65) Prior Publication Data

US 2009/0078465 A1 Mar. 26, 2009

(30) Foreign Application Priority Data

Jun. 22, 2004 (GB) ..... 0413901.0

(51) Int. Cl.
*E21B 7/08* (2006.01)

(52) U.S. Cl. ..... 175/76; 175/61

(58) Field of Classification Search ..... 175/61, 175/73, 76

See application file for complete search history.

(56) References Cited

U.S. PATENT DOCUMENTS

| | | | | | |
|---|---|---|---|---|---|
| 3,561,549 | A | * | 2/1971 | Garrison et al. | 175/76 |
| 4,015,673 | A | * | 4/1977 | Craig et al. | 175/61 |
| 4,108,256 | A | * | 8/1978 | Moore, III | 175/61 |
| 4,456,080 | A | * | 6/1984 | Holbert | 175/61 |
| 4,523,652 | A | * | 6/1985 | Schuh | 175/61 |
| 4,638,873 | A | * | 1/1987 | Welborn | 175/73 |

(Continued)

FOREIGN PATENT DOCUMENTS

| | | |
|---|---|---|
| FR | 2 593 226 | 7/1987 |
| WO | WO 2004/048745 | 6/2004 |

OTHER PUBLICATIONS

Rampelmann, K, Written Opinion of the International Searching Authority, Dec. 21, 2005, 8 pages, European Patent Office, Europe.

*Primary Examiner* — David Bagnell
*Assistant Examiner* — Blake Michener
(74) *Attorney, Agent, or Firm* — Oathout Law Firm; Mark A. Oathout

(57) ABSTRACT

This invention relates to a steerable drill bit arrangement, in particular for the use in drilling boreholes for oil and gas extraction. According to the invention there is provided a steerable drill bit arrangement comprising a drill bit, a steering component and a stabilizer, the steering component being adapted to provide a steering force which in use can drive the drill bit along a non-linear path, the stabilizer being located between the drill bit and the steering component and in use providing a fulcrum for the steering force provided by the steering component, the position of the fulcrum provided by the stabilizer being adjustable relative to the drill bit and the steering component. In use, the position of the fulcrum can be adjusted to vary the maximum curvature of the borehole and to suit the rock type(s) being drilled.

14 Claims, 3 Drawing Sheets

U.S. PATENT DOCUMENTS 4,664,206 A * 5/1987 Butler ..... 175/325.2
4,729,438 A * 3/1988 Walker et al. ..... 175/76
4,762,186 A * 8/1988 Dech et al. ..... 175/61
5,311,953 A * 5/1994 Walker ..... 175/61
7,503,408 B2 * 3/2009 Walker et al. ..... 175/76
2003/0121702 A1 * 7/2003 Downton et al. ..... 175/76

* cited by examiner

STEERABLE DRILL BIT ARRANGEMENT

FIELD OF THE INVENTION

This invention relates to a steerable drill bit arrangement, in particular for the use in drilling boreholes for oil and gas extraction.

DESCRIPTION OF THE PRIOR ART

To extract oil and gas from underground reserves, it is necessary to drill a borehole into the reserve. Traditionally, the drilling rig would be located above the reserve (or the location of a suspected reserve) and the borehole drilled vertically (or substantially vertically) into the reserve. The reference to substantially vertically covers the typical situation in which the drill bit deviates from a linear path because of discontinuities in the earth or rock through which the borehole is being drilled.

Later, steerable drilling systems were developed which allowed the determination of a path for the drill bit to follow which was non-linear, i.e. it became possible to drill to a chosen depth and then to steer the drill bit along a curve until the drill was travelling at a desired angle, and perhaps horizontally. Steerable drill bits therefore allow the recovery of oil and gas from reserves which were located underneath areas in which a drilling rig could not be located.

To facilitate drilling operations, a drilling fluid (called "mud") is pumped into the borehole. The mud is pumped from the drilling rig through the hollow drill string, the drill string being made up of pipe sections connecting the drill bit to the drilling rig. The mud exits the drill string at the drill bit and serves to lubricate and cool the drill bit, as well as flushing away the drill cuttings. The mud and the entrained drill cuttings flow to the surface around the outside of the drill string, specifically within the annular region between the drill string and the borehole wall.

To allow the mud to return to the surface, the drill string is of smaller cross-sectional diameter than the borehole. In a 6 inch (approx. 15 cm) borehole, for example, the outer diameter of the bottom hole assembly will typically be 4.75 inches (approx. 12 cm), with the majority of the drill string comprising drill pipe sections of smaller diameter.

It is necessary to stabilise such a drill string, i.e. during drilling (when the drill string rotates) the gap between the drill string and the borehole wall allows the drill string to move transversely relative to the borehole, possibly causing directional errors in the borehole, damage to the drill string, and/or lack of uniformity in the cross-section of the borehole. To avoid this, stabilizers are included at spaced locations along the length of the drill string, the stabilizers having a diameter slightly less than the diameter of the borehole (e.g. a diameter of $5\frac{31}{32}$ inches (15.16 cm) for a 6 inch (15.24 cm) borehole, or $\frac{1}{32}$ of an inch (0.08 cm) less than the diameter of the borehole). The stabilizers substantially prevent the unwanted transverse movement of the drill string. To allow the passage of mud the stabilizers necessarily include channels, which are usually helical.

Stabilizers such as those described above are available for example from Darron Oil Tools Limited, of Canklow Meadows, West Bawtry Road, Rotherham, S60 2XL, England (GB).

An early steering arrangement employed a downhole mud motor and a bent housing, in which only the drill bit would rotate (driven by the mud motor for which the motive force is the flow of the drilling fluid). Such arrangements have the disadvantage that the non-rotating drill string incurs greater frictional resistance to movement along the borehole, which limits the horizontal reach of the system.

Another early system utilised the effect of gravity upon the drill string to "steer" the drill bit towards and away from the vertical. However, this system had the major shortcoming of not allowing steering of the drill bit in the horizontal direction.

More recent systems employ a steering component having actuators which are controlled from the surface, and which act directly or indirectly upon the borehole wall to push the drill string transversely relative to the borehole. The drill bit is also be pushed transversely, and can therefore be forced to deviate from a linear path, in any direction, (i.e. upwards, downwards and sidewards).

In some of these systems the outer part of the steering component (i.e. that part which can engage the borehole wall) is arranged to rotate with the drill string, and in others the outer part of the steering component does not rotate with the drill string.

A steering component with a non-rotating outer part is described in EP-A-1 024 245 and its equivalent U.S. Pat. No. 6,290,003. This system has a pipe through which mud can flow towards the drill bit, and a sleeve surrounding the pipe. The sleeve carries actuators which act upon the pipe within the sleeve to decentralise the drill string.

Such systems are generally known as "push the bit" systems, since the steering component pushes the drill bit sideways relative to the borehole.

A disadvantage of the "push the bit" systems is that the drill bit is designed to work most efficiently when it is urged longitudinally against the earth or rock, and "push the bit" systems force the drill bit to move transversely, so that a transverse cutting action is required in addition to the longitudinal cutting action. The result is that the borehole wall becomes roughened and/or striated, which can affect the drilling operation by impairing the passage of the stabilizers, and can also detrimentally affect the operation of downhole measuring tools which are required to contact the borehole wall.

To overcome this disadvantage, systems known as "point the bit" have been developed, in which a stabilizer is added between the steering component and the drill bit, the stabilizer acting as a fulcrum and reducing or eliminating the transverse force component acting upon the drill bit, so ensuring that the drill bit would always be cutting longitudinally. Thus, in "point the bit" systems, the axis of the drill bit is substantially aligned with the axis of the borehole whether a steering force is being applied or not.

"Point the bit" steering arrangements have been used successfully in many drilling operations. However, as with other steering arrangements they have the disadvantage that the degree of curvature they are able to provide is dependent to large extent upon the structure of the rock through which the borehole is being drilled. Thus, in softer rock there is a significant tendency for the hole to be made oversize, in particular by the undesirable cutting action of the stabilizers, and an oversize borehole will affect the steering force which can be applied at the bit.

Also, if the borehole is required to pass from softer rock into harder rock with the border between the two rock types being at a shallow angle to the longitudinal axis of the drill bit, the drill bit will tend to deviate from the desired curvature as it moves more easily in the softer rock and tends to move along the border rather than through it. It is rare for a borehole to be drilled through rock of consistent hardness, so that the variable conditions present a significant disadvantage to users of the known steering arrangements and reduce the drilling accuracy (both in terms of direction and size of the borehole) which can be obtained from such systems.

SUMMARY OF THE INVENTION

The present inventors have realised that in "point the bit" arrangements the positions of the steering component and stabilizer in relation to the drill bit has a significant effect upon the drilling performance in each type of rock encountered, and that different relative positions can be used in different types of rock to achieve a greater accuracy in the direction and size of the borehole.

It is therefore the object of the present invention to reduce or avoid the above-stated disadvantage with the known drill steering systems, and in particular the known "point the bit" steering systems.

According to the invention, therefore, there is provided a steerable drill bit arrangement comprising a drill bit, a steering component and a stabilizer, the steering component comprising means to drive the drill bit along a non-linear path, the stabilizer being located between the drill bit and the steering component and providing a fulcrum for steering forces provided by the steering component, characterised in that the position of the fulcrum provided by the stabilizer is adjustable relative to the drill bit and the steering component.

Adjustment of the position of the fulcrum relative to the drill bit and the steering component alters the mechanical advantage and therefore the performance of the steering arrangement. Specifically, the present inventors have realised that if the fulcrum is closer to the steering component and further from the drill bit the deviation rate or curvature of the borehole is large but the lateral force upon the drill bit is small, whereas if the stabilizer is closer to the drill bit and further from the steering component the deviation rate is small but the lateral force upon the drill bit is large, and the drill bit can for example be forced to deviate from softer rock into harder rock.

The stabilizer preferably comprises a pipe through which drilling mud can flow towards the drill bit and a number of blades which can engage the surface of a borehole being drilled. Preferably, the blades are located at one end of the stabilizer and the orientation of the stabilizer can be reversed to alter the position of the blades relative to the drill bit and the steering component. Since it is the blades which engage the borehole which act as the fulcrum for the drill string, reversing such a stabilizer will alter the relative position of the fulcrum. The steerable drill bit arrangement allows the stabilizer to be located between the drill bit and the steering component in either of two orientations, the relative position of the fulcrum being determined upon assembly of the bottom hole assembly at the surface.

Alternatively, the position of the fulcrum can be adjusted remotely, for example downhole, perhaps by allowing the blades of the stabilizer to move relative to the pipe. Such movement can be longitudinal, i.e. the blades comprising the fulcrum can be arranged to slide along the pipe (towards/away from the drill bit and away from/towards the steering component respectively) between one of two (or more) positions of use. Alternatively, such movement can be radial, i.e. the stabilizer can have two (or more) sets of blades which are selectively retracted or expanded so that only a chosen set of blades, at a chosen position relative to the drill bit and steering component, engage the surface of the borehole.

Preferably, the leading and trailing edges of the blades of the stabilizer are tapered or curved to match the maximum design curvature of the borehole. Thus, the corners present at the leading and trailing edges of the blades are removed, avoiding the tendency of these corners to cut into the borehole, inadvertently increasing the diameter of the borehole. It has been discovered that such shaping of the blades is required in the present arrangement since the deviation rate of the borehole is far greater than with prior arrangements, increasing the likelihood that the leading and trailing edges of the blades would otherwise cut into the surface of the borehole.

With the present arrangement it is therefore possible to set the position of the stabilizer (or more properly the fulcrum point provided by the stabilizer) to suit the rock type being drilled and the deviation rate required. The rock type being drilled can readily be determined by examination of the drill cuttings or from conventional downhole analysis.

In test drilling through a block of concrete, a deviation rate of up to 300 per hundred feet has been achieved with the present arrangement, which is at least three times greater than could normally be achieved with prior art systems.

There is also provided a stabilizer for use in a steerable drill bit arrangement, the stabilizer having a first end part comprising a pipe through which drilling mud can flow towards the drill bit and a second end part having a number of blades which can engage the surface of a borehole being drilled, the stabilizer having a first end connector adapted for connection to a drill bit and a second end connector adapted for connection to the steering component, the first end connector and the second end connector being similarly-formed so that alternatively the first end connector can be connected to the steering component and the second end connector connected to the drill bit. Providing similarly-formed connectors at both ends of the stabilizer allow the stabilizer to be reversible, and this provides an easy and effective way to adjust the position of the fulcrum provided by the stabilizer when used between a steering component and a drill bit.

BRIEF DESCRIPTION OF THE DRAWINGS

The invention will now be described, by way of example, with reference to the accompanying drawings, in which.

DESCRIPTION OF THE PREFERRED EMBODIMENTS

Figure 1:
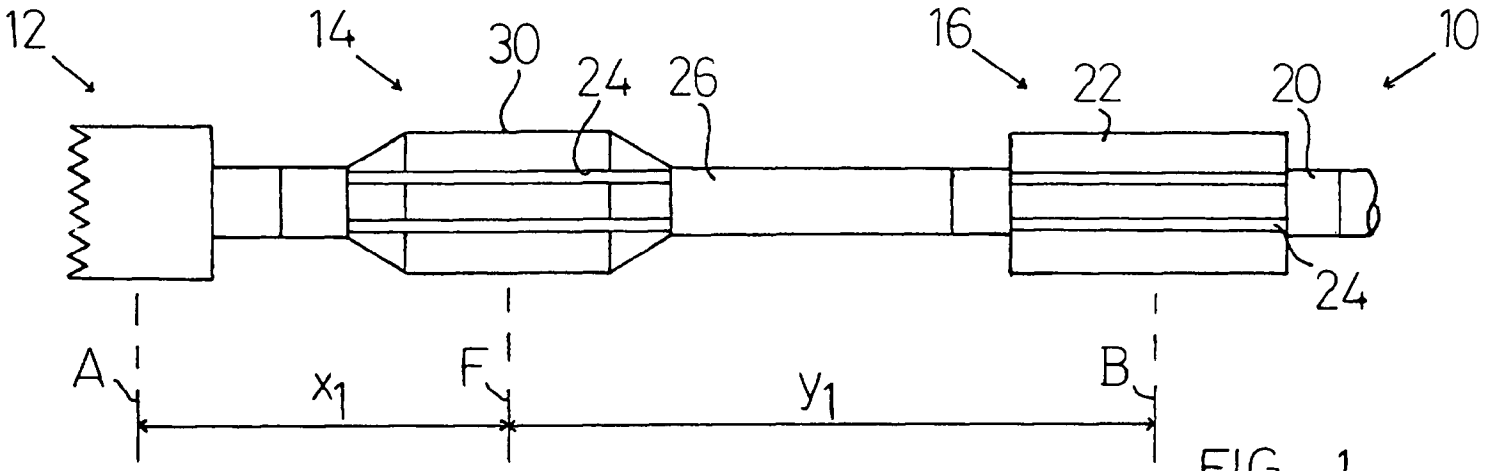
FIG. 1 shows a schematic representation of the arrangement according to the invention, in a first orientation.

The steerable drill bit arrangement 10 according to the invention comprises a drill bit 12, a stabilizer 14 and a steering component 16. The drill bit 12 can be of any known design suited to drilling through the rock type to be encountered.

The steering component 16 comprises a pipe 20 and a sleeve 22, and serves to decentralise the pipe 20 within the sleeve (and therefore also the borehole (not shown)), so that the drill bit 12 is forced to deviate from a linear path. For example, if the steering component 16 is used to force the pipe 20 downwardly in the orientation shown, then the drill bit 12 will be forced upwardly, the stabilizer 14 acting as the fulcrum.

In known fashion, the pipe 20, the stabilizer 14, and the other pipe sections which make up the drill string, are hollow so as to allow the passage of mud from the surface to the drill bit 12. Also, the steering component 16 and the stabilizer 14 include channels 24 which permit the passage of mud (and entrained drill cuttings) from the drill bit 12 back to the surface.

In preferred embodiments the steering component 16 is constructed as described in U.S. Pat. No. 6,290,003, which document is incorporated by reference herein, and which steering component will not be described further.

As in all "point the bit" drilling arrangements, the stabilizer 14 is located between the drill bit 12 and the steering component 16, and so acts as a fulcrum for the drill string, causing the drill bit 12 to be urged to deviate from a linear path when the steering component 16 moves the pipe 20 relative to the sleeve 22.

In this embodiment, the stabilizer 14 comprises a pipe section 26, only one end of which carries blades 30. As with other stabilizers, the maximum diameter of the blades 30 is designed to be slightly smaller than the diameter of the borehole drilled by the drill bit 12. Both ends 32 and 34 of the stabilizer 14 are correspondingly formed (this feature being shown in the embodiment of FIG. 5 in which both ends 132 and 134 have a tapered female threaded opening 56 as commonly used in drill strings) so as to connect to both of the drill bit 12 and to the steering component 16, so that the stabilizer 14 can be fitted into the drill string in one of two orientations. In the first orientation shown in FIG. 1 the blades are close to the drill bit 12, whilst in the second orientation shown in FIG. 2 they are further from the drill bit 12 (and correspondingly closer to the steering component 16).

The operation of the steerable drill bit arrangement according to the invention can be represented by a simple geometrical model. Using FIGS. 1 and 2, the force applied by the steering component 16 acts at its approximate centre-line B, the fulcrum is provided at the approximate centre-line of the stabilizer 14 at plane F, and the resultant force on the drill bit 20 acts approximately at plane A. The distance between planes A and F in the orientation of FIG. 1 is $x_1$, and the distance between planes B and F is $y_1$.

The mechanical advantage (M) of such an arrangement is given by:

$$M=y_1/x_1,$$

so that the transverse force applied to the drill bit 12 is $y_1/x_1$ times the transverse force applied by the steering component 16.

Also, the ratio of the resultant transverse deflection at the drill bit (ΔA) to the applied transverse deflection at the steering component (ΔB) is:

$$\Delta A/\Delta B=x_1/y_1$$

Figure 2:
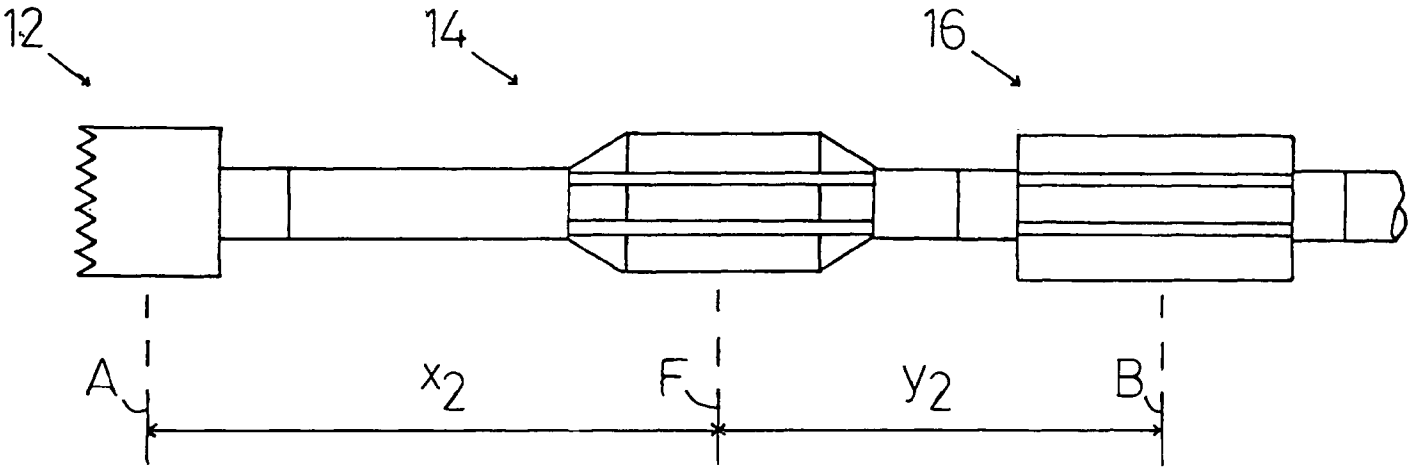
FIG. 2 shows a representation as FIG. 1, in a second orientation.

In the orientation of FIG. 2, on the other hand, the distance between planes A and F is $x_2$ and the distance between planes B and F is $y_2$.

The mechanical advantage (M) of the arrangement in this orientation is given by:

$$M=y_2/x_2,$$

so that the transverse force applied to the drill bit is $y_2/x_2$ times the transverse force applied by the steering component, and the ratio of the resultant transverse deflection at the drill bit (□A) to the applied transverse deflection at the steering component (□B) is:

$$\square A/\square B=x_2/Y_2$$

It will be understood that the greater the (steering) force which can be applied at the drill bit 12 the smaller will be the resulting deflection at the drill bit, and therefore the smaller the deviation rate or curvature of the drilled borehole.

In the orientation of FIG. 1 therefore, the mechanical advantage, and the transverse force which can be applied to the drill bit, is large. This orientation is therefore suitable for ensuring that the drill bit most closely follows the desired path through rock types of varying hardness, the arrangement being particularly suitable for driving the drill bit through an angled interface from softer rock into harder rock. In the orientation of FIG. 2 on the other hand the mechanical advantage is lower but the applied deflection is greater so that the deviation rate or curvature of the borehole is also larger.

In one practical embodiment the dimension $x_1$ is approximately 12 inches (30.5 cm), the dimension $y_1$ is approximately 36 inches (91.4 cm), the dimension $x_2$ is approximately 20 inches (50.8 cm), the dimension $y_2$ is approximately 28 inches (71.1 cm), giving two possible mechanical advantages for such an embodiment of approximately 3 and 1.4.

It has been determined that arrangements in which the mechanical advantage can be altered from around 1 to around 4 will enable the arrangement to satisfy the requirements of borehole accuracy and deviation rate for most rock types, but clearly mechanical advantages outside this range could be used if this is determined to be appropriate for particular applications.

Figure 7:
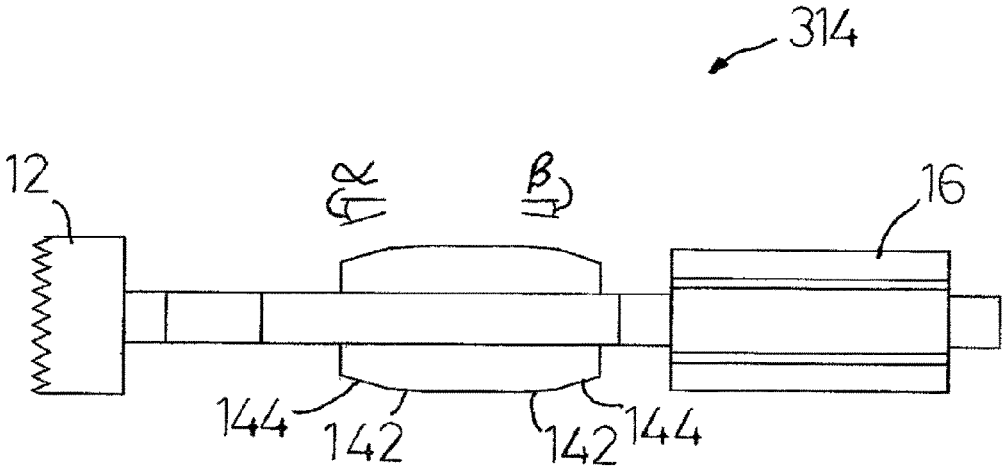
FIG. 7 shows an alternative steerable drill bit arrangment.

Also, it is expected that the arrangement requires only two different mechanical advantages, i.e. two different relative positions for the fulcrum, and an arrangement such as that of FIGS. 1 and 2 provides only two possible adjustment positions. However, more than two adjustment positions can be provided by the use of spacers such as the spacer 54 in FIG. 7 which is located between the drill bit 12 and the stabilizer 314, but which may alternatively or additionally be located between the stabilizer 314 and the steering component 16, i.e. the spacer 54 is movable between these two positions, or a spacer may be used in both of these positions.

In the above-described arrangements, the distance between the drill bit 12 and the steering component 16 remains the same and this reduces the complexity of the calculations of mechanical advantage which are undertaken. However, if spacers are used the addition or removal of a spacer from the drill string can vary that distance and affect the resulting mechanical advantage.

In the embodiment shown in FIGS. 1 and 2 the blades 30 are fixed upon the pipe section 26, and so adjustment of the mechanical advantage can only be undertaken at the surface. This will be acceptable in many applications where the rock type being drilled is not too variable.

Figure 5:
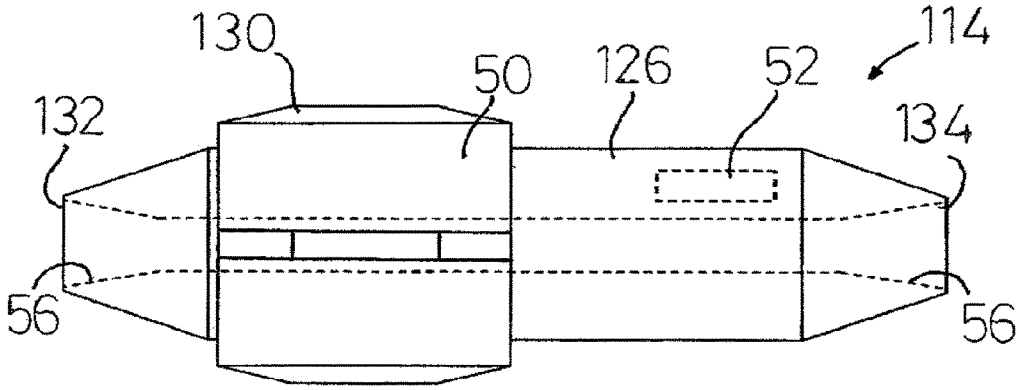
FIG. 5 shows a side view of an alternative stabilizer for use in the arrangment.
Figure 6:
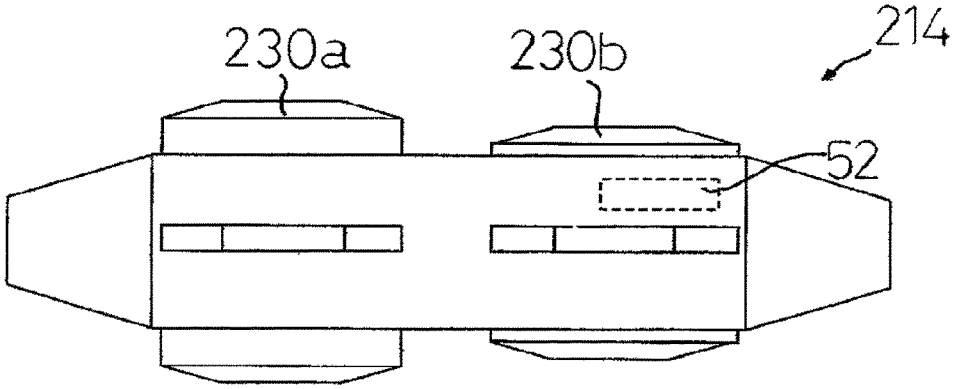
FIG. 6 shows a side view of another alternative stabilizer.

In the alternative embodiments shown in FIGS. 5 and 6 it is arranged that the stabilizer 114 and 214 can be adjusted downhole. In the embodiment of FIG. 5 the blades 130 are carried by a sleeve 50 which can be driven along the pipe section 126, the sleeve 50 having two (or in other embodiments more than two) designated positions in which it can be secured relative to the pipe section during drilling operations. The alternative embodiment of FIG. 6 utilises two (or in other embodiments more than two) sets of blades 230*a*, 230*b* which can be moved radially between an extended position (shown for the blades 230*a*) in which they can engage the borehole and a retracted condition shown for the blades 230*b*) in which they cannot engage the borehole, the stabilizer 214 being controlled remotely by a controller 52 to cause a selected one of the sets of blades 230*a,b* to engage the borehole at a given time.

Figure 3:
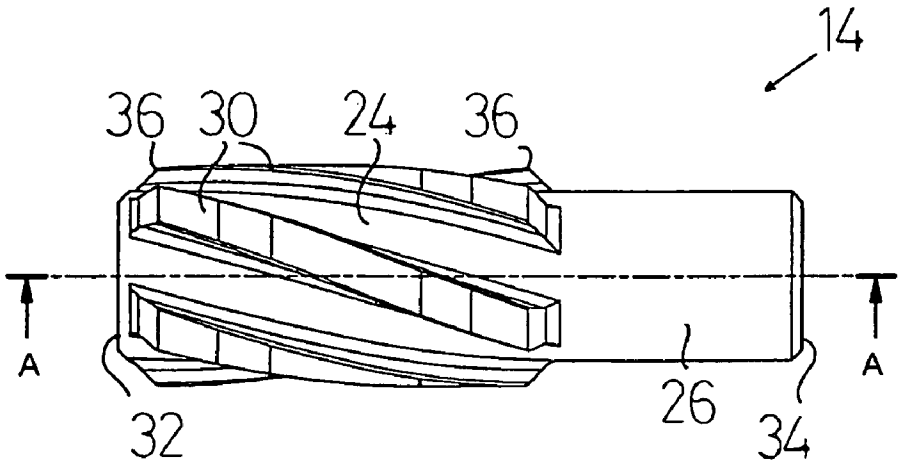
FIG. 3 shows a side view of a stabilizer used in the arrangement.

The form of the preferred embodiment of the blades of the stabilizer 14 are shown in FIG. 3. Thus, whilst for simplicity the blades 30 (and channels 24) in FIGS. 1 and 2 are shown to be linear, in most practical embodiments the blades (and therefore also the channels therebetween) will be helical in common with most conventional stabilizers. Importantly, in the present arrangement the leading and trailing ends of the blades are tapered rather then ending at a 90° corner. The taper is relatively shallow, and designed to match the maximum curvature of the borehole (e.g. 30° per hundred feet), and so is not visible in this figure. In practice, this will result in the removal of material to a depth of up to around ten thousandths of an inch (around one quarter of a millimeter), but the removal of even this small amount of material will avoid the tendency of the corners of the leading and trailing edges of the blades to cut into the borehole and inadvertently increase the diameter of the borehole.

Figure 4:
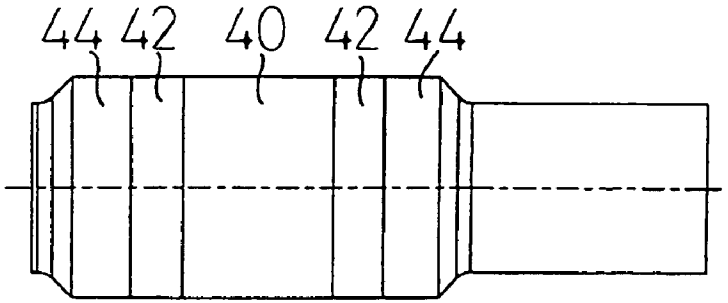
FIG. 4 shows a side view of the stabilizer body prior to machining of the blades.

FIG. 4 shows a side view of the stabilizer body prior to machining of the blades 30, for the purpose of showing the taper applied to the blades (though it will be understood that in some cases the blades are machined before the taper). Ideally, the edge of the blades 30 should be curved with a radius of curvature corresponding to the maximum curvature of the drilled hole, such curvature reducing the likelihood that the leading or trailing edges 36 will cut into the borehole. In practice, however, it is easier to taper the edges of the blades, and it has been found that a central non-tapered section 40, a first tapered section 42 to either side thereof, and a second tapered section 44 at the ends of the blades 30 provides sufficient curvature. As with FIG. 3, the tapering applied to a practical stabilizer such as that of FIG. 4 is too shallow to be visible in the drawing, but the stabilizer 314 in FIG. 7 has significantly exaggerated tapered end sections for the purpose of showing the angle $\alpha$ of the taper of the sections 144, and the smaller angle $\beta$ of the taper of the sections 142.

The length of the sections 40, 42 and 44 along the longitudinal axis A-A of the stabilizer 14 can be varied, as can the relative angles between neighbouring sections, to suit the particular application and degree of curvature required. Typically, the smaller the borehole diameter the greater the curvature desired, so that the relative angles between the neighbouring sections would typically be greater in a smaller diameter stabilizer.

In one stabilizer 14, the diameter of the central section 40 is nominally 5.974 inches (15.174 cm), the diameter at the junction between the sections 42 and 44 is nominally 5.946 inches (15.103 cm), and the diameter at the leading and trailing edges 36 is nominally 5.912 inches (15.016 cm).

It will be understood that the drilling of an oversize borehole has a direct effect upon the deviation rate which can be achieved at the drill bit 12; with an oversize borehole the predetermined deflection of the pipe 20 within the sleeve 22 of the steering component 16 will result in a smaller than expected deflection at the drill bit 12 both because the sleeve 22 must first be moved laterally to engage the oversize borehole, and also because the stabilizer 14 will move laterally before it begins to act as a fulcrum.

Tests conducted prior to filing the patent application have demonstrated that orientations such as that of FIG. 2 (having a lower mechanical advantage) are less likely to drill an oversize borehole in most of the rock types likely to be encountered. An oversize borehole arises not only because of the cutting effect of the stabilizer blades, but also because of unwanted vibrations induced into the drill bit and stabilizer during drilling.

The type of drill bit used, and the rock type being drilled, will also both affect the likelihood of drilling an oversize borehole. In a test drilling on concrete a 6⅛ inch (15.56 cm) hole was drilled with the arrangement in the orientation of FIG. 2 which was measured at only approximately 15 thousandths of an inch (0.038 cm) oversize.

Because of the accuracy of the sizing of the borehole which is achievable with use of the present invention, and in particular by matching the mechanical advantage of the steering arrangement to the rock type being drilled, certain other modifications to the bottom hole assembly can be made. For example, a tricone drill bit was used to which lug pads were added. Lug pads are known to be used to add stability to such drill bits, but generally it is understood that the addition of lug pads will reduce the deviation rate achievable. With the present invention, however, by matching the mechanical advantage of the steering arrangement to the rock type being drilled, the deviation rate was increased by the addition of lug pads (it is understood because of the improved accuracy of sizing of the borehole and the consequent effect that had upon the deviation rate at the drill bit).

When using a stabilizer adjacent to the drill bit as in the present invention, it is desired that the stabilizer does not cut into the surface of the borehole, since that would reduce its effectiveness as a fulcrum for steering the drill bit. The removal of material from the leading and trailing edges of the stabilizer blades, and the detailed profiling of the stabilizer blades, is designed to enable the stabilizer blades to provide bearing surfaces rather than cutting surfaces. Alternatively or additionally, the stabilizer can incorporate a rotatable sleeve so that the blades can rotate relative to the pipe and can remain (substantially) stationary relative to the surface of the borehole.

Also, it is desirable that the stabilizer acts to stabilise the drill bit against unwanted vibrations or other movements during drilling, and (particularly when in the orientation of FIG. 1) the stabilizer blades provide a means to dampen out bit oscillations and enable a variety of drill bit designs to be used. Furthermore, if the drill bit is cutting an undersized hole, and notwithstanding that the blades are profiled not to cut, the movement of the stabilizer along the undersized hole will act to ream (increase the diameter of) the borehole, and will ensure that the steering component acts within a more correctly dimensioned borehole.

It can be arranged that the stabilizer 14 provides a greater, lesser, or equal flow restriction to the mud and entrained drill cuttings than the steering component 24. For example, the channels 24 in the stabilizer 14 can be of different or similar cross-sectional area to the channels 24 in the steering component 16, as desired. It may for example be desirable to ensure that the stabilizer is the greatest restriction to the flow of mud and entrained drill cuttings as this will reduce the pressure drop across the steering component 16 and reduce the likelihood of damage to that component.

The invention claimed is:

1. A steerable drill bit arrangement comprising a drill bit, a steering component and a stabilizer, the steering component being adapted to provide a steering force which in use can drive the drill bit along a non-linear path, the stabilizer being located between the drill bit and the steering component, the stabilizer having a tubular body with a longitudinal axis and a number of blades projecting radially outward from a tubular body, each of the blades providing a bearing surface which lies radially outward of the tubular body, the whole of the bearing surface being adapted to engage a non-linear borehole during use whereby the bearing surfaces of the blades of the stabilizer provides a fulcrum for the steering force provided by the steering component, the bearing surface of each blade comprising five sections at different longitudinal positions:

a central section which is not tapered;

two end sections, an end section being located at each end of the blades, the end sections having a first taper; and two intermediate sections, an intermediate section being located between the central section and each of the end sections, the intermediate sections having a second taper, the angle of the first taper relative to the longitudinal axis being greater than the angle of the second taper relative to that axis, the radial distance between the end sections of the bearing surface and the tubular body being bridged by further tapered surfaces which do not form part of the bearing surface.

2. A steerable drill bit arrangement according to claim 1 in which the position of the fulcrum provided by the bearing surface of each of the blades of the stabilizer is adjustable relative to the drill bit and the steering component.

3. A steerable drill bit arrangement according to claim 2 in which the stabilizer has a first end part comprising a pipe through which drilling mud can flow towards the drill bit and a second end part having the number of blades.

4. A steerable drill bit arrangement according to claim 3 in which the orientation of the stabilizer can be reversed during assembly of the arrangement so as to alter the longitudinal position of the blades relative to the drill bit and the steering component.

5. A steerable drill bit arrangement according to claim 2 in which the position of the fulcrum can be adjusted remotely.

6. A steerable drill bit arrangement according to claim 5 in which the stabilizer comprises a pipe through which drilling mud can flow towards the drill bit and the number of blades, in which the blades are movable relative to the pipe.

7. A steerable drill bit arrangement according to claim 6 in which the stabilizer has a longitudinal axis, and in which the blades are movable in a longitudinal direction.

8. A steerable drill bit arrangement according to claim 6 in which the stabilizer has a longitudinal axis and has two sets of blades arranged to engage the surface of the borehole at different longitudinal positions, the blades being adapted to be selectively retracted or expanded.

9. A steerable drill bit arrangement according to claim 2 in which the steering component is adapted to provide the steering force at a steering plane, in which the bearing surface of each of the blades of the stabilizer is adapted to provide the fulcrum at a fulcrum plane, and in which the steering force acts upon the drill bit at a steered plane, the ratio of the distances between the fulcrum plane and the steering plane and the fulcrum and the steered plane defining the mechanical advantage of the arrangement, the mechanical advantage being altered by adjustment of the position of the fulcrum, the position of the fulcrum being adjustable such that the mechanical advantage can be altered from around 1 to around 4.

10. A steerable drill bit arrangement according to claim 9 in which the position of the fulcrum is adjustable such that the mechanical advantage can be altered from approximately 1.4 to approximately 3.

11. A steerable drill bit arrangement according to claim 2 in which the fulcrum has only two adjustment positions.

12. A steerable drill bit arrangement according to claim 2 in which at least one spacer is located between the stabilizer and at least one of the drill bit and steering component to increase the number of available adjustment positions for the fulcrum.

13. A stabilizer adapted for connection between a drill bit and a steering component in a steerable drill bit arrangement, the stabilizer comprising a tubular body through which drilling mud can flow towards the drill bit and a number of blades which project radially outward from the tubular body, each blade providing a bearing surface which lies radially outward of the tubular body, the whole of each bearing surface being adapted to engage a non-linear borehole during use, whereby the bearing surface of each of the blades of the stabilizer provide a fulcrum for a steering force provided by the steering component, the bearing surface comprising five sections at different logitudinal positions;

a central section which is not tapered;

two end sections, an end section being located at either end of the blades, the end sections having a first taper; and two intermediate sections, an intermediate section being located between the central section and each of the end sections, the intermediate sections having a second taper, the angle of the first taper relative to the longitudinal axis being greater than the angle of the second taper relative to that axis, the radial distance between the end sections and the tubular body being bridged by further tapered surfaces which do not form part of the bearing surface.

14. A stabilizer according to claim 13 having a first end connector adapted for connection to the drill bit and a second end connector adapted for connection to the steering component, the first end connector and the second end connector being similarly-formed whereby the stabilizer is reversible.

* * * * *